US007125197B2

(12) United States Patent
Krewsun et al.

(10) Patent No.: US 7,125,197 B2
(45) Date of Patent: Oct. 24, 2006

(54) METHOD AND APPARATUS FOR A MINIMALLY AGGRESSIVE VEHICLE STOPPING SYSTEM

(76) Inventors: Bohdan Krewsun, 3715 Nercis Dr., La Mesa, CA (US) 91945; Brad Carr, 1658 Promontory Ridge Way, Vista, CA (US) 92081

( * ) Notice: Subject to any disclaimer, the term of this patent is extended or adjusted under 35 U.S.C. 154(b) by 0 days.

(21) Appl. No.: 10/426,809

(22) Filed: Apr. 30, 2003

(65) Prior Publication Data

US 2003/0235466 A1 Dec. 25, 2003

Related U.S. Application Data

(60) Provisional application No. 60/376,910, filed on May 1, 2002.

(51) Int. Cl.
*E01F 13/00* (2006.01)

(52) U.S. Cl. ..... 404/6; 49/9; 49/49; 256/13.1

(58) Field of Classification Search ..... 404/6; 49/9, 34, 49, 404, 133, 131, 34; 256/1, 13.1
See application file for complete search history.

(56) References Cited

U.S. PATENT DOCUMENTS 5,823,705 A * 10/1998 Jackson et al. ..... 404/6
6,312,188 B1 * 11/2001 Ousterhout et al. ..... 404/6

* cited by examiner

*Primary Examiner*—Thomas B. Will
*Assistant Examiner*—Alexandra Pechhold

(57) ABSTRACT

A vehicle capture net disposed between a pair of towers each of which includes a shaft, a pair of spools coupled to the shaft, and a pair of straps connected to the net. Each strap is wound on a spool. A brake is coupled to the shaft and to the spools for providing a restraining force of increasing magnitude as the straps are unwound. Unwinding of the straps from the spools advances the pair of spools on threaded portions of the shaft to compress the adjacent braking surfaces against each other. The vehicle is stopped by deploying a vehicle capture net connected to at least one pair of straps each wound on a spool, permitting the vehicle to collide with the capture net and to unwind the straps from corresponding spools, and providing a restraining force of increasing magnitude on the straps as the straps are unwound from the spools.

8 Claims, 5 Drawing Sheets

METHOD AND APPARATUS FOR A MINIMALLY AGGRESSIVE VEHICLE STOPPING SYSTEM

RELATED APPLICATIONS

The present application is related to U.S. Provisional Patent Application Ser. No. 60/376,910, filed on May 1, 2002, which is incorporated herein by reference and to which priority is claimed pursuant to 35 USC 119.

BACKGROUND OF THE INVENTION

1. Field of the Invention

The invention relates to the field of vehicle restraints, and in particular to vehicle capture nets or barriers.

2. Description of the Prior Art

The need for a system to stop an unauthorized moving car approaching the entry to a restricted area is of utmost importance to law enforcement and security personnel. This is particularly important in view of heightened awareness of possible terrorist attacks against both government and non-government facilities. Possible solutions to the problem of stopping moving vehicles have been disclosed in Marcotullio et al, U.S. Pat. Nos. 5,993,104 and 5,829,912; Jackson et al, U.S. Pat. No. 5,624,203; and Terio, U.S. Pat. No. 4,576,507. The prior art teaches a variety of techniques for arresting the automobile motion, including hydraulic, pneumatic, as well as governor controlled mechanical braking systems to accomplish the deceleration of the automobile after it engages the barrier, and include methods of storing and deploying the barrier from a storage location.

BRIEF SUMMARY OF THE INVENTION

The invention is a vehicle stopping system including a vehicle capture net disposed between a pair of towers. Each tower includes a stanchion comprising a shaft, a pair of spaced apart spools coupled to the shaft, and a corresponding pair of straps having one end coupled to one of the pair of spools and the other end coupled to the net. Each strap is wound on one of the spools. A brake is coupled to the shaft and is operatively connected to the spools for providing a restraining force of increasing magnitude on the straps as the straps are unwound from the spools.

The brake comprises a compression frictional brake in which the breaking force increases with the degree of compression. The degree of compression increases as the strap unwinds from the spool increases. In the illustrated embodiment the brake is a disk brake, but any other mechanical or frictional brake could be employed as an equivalent with appropriate modifications according to the spirit and scope of the invention.

The shaft has threaded portions to which the pair of spools are coupled. Unwinding of the straps from the spools advances the pair of spools on the corresponding threaded portions to compress the adjacent braking surfaces against each other. At least one of the braking surfaces is resiliently supported against the adjacent braking surface. Thus, the brake comprises a mechanical brake providing a braking force proportional to the degree of compression of the mechanical brake.

More specifically the mechanical brake comprises two braking surfaces in frictional relationship with each other and the degree of compression is the magnitude of displacement of one braking surface relative to the other braking surface. The magnitude of displacement of one braking surface relative to the other braking surface comprises the screw advance of the spools on the shaft toward the brake as caused by the unwinding of the straps from the spools. The displacement of one braking surface relative to the other braking surface causes a compression of at least one compression spring which then defines the magnitude of force by which the braking surfaces are urged against each other. The displacement of one braking surface relative to the other braking surface causes a compression of at least one compression spring which then defines the magnitude of force by which the braking surfaces are urged against each other. The shaft and spools are provided with and engaged with each other by a Krewsun thread, which is a flat faced screw with a thread-to-thread clearance of at least 0.010 inch.

The vehicle stopping system further comprises a mechanism for releasing the brake and for rewinding the straps onto the spools. The spools are rotationally fixed to the shaft in this embodiment. The means for rewinding the straps onto the spools comprises a single electric motor and clutch assembly coupled to the shaft. The braking means includes a threaded rod directly coupled to the motor and clutch assembly. The rod is coupled to the shaft by a block and axial slot combination which permits a degree of axial movement of the block, so that when the rod is selectively held rotationally fixed by the motor and clutch assembly, unwinding of the spools rotates the shaft and axially activates the braking means.

In one embodiment the mechanism for releasing the braking means includes a single electric motor/clutch assembly directly coupled to a threaded axial rod which is coupled to the shaft by means of a block and axial slot combination. Rotation of the rod by the motor/clutch assembly in a predetermined direction serves to release the braking means. Further rotation of the rod by the motor/clutch assembly rotates the shaft by means of the block and axial slot combination thereby serving to rewind the straps onto the spools.

The invention is also defined as a method of stopping a vehicle comprising the steps of deploying a vehicle capture net connected to at least one pair of straps each wound on a spool, permitting the vehicle to collide with the capture net and to unwind the straps from corresponding spools, and providing a restraining force of increasing magnitude on the straps as the straps are unwound from the spools.

The step of providing a restraining force of increasing magnitude on the straps comprises the step of providing mechanical friction braking to generate restraining force in which the brake pressure is proportional to the length of the straps unwound from the spools. The step of providing mechanical friction braking to generate restraining force comprises generating an axial displacement of two friction disk brake surfaces toward each other as a function of the length of the straps unwound from the spools, and simultaneously generating an axially compressive force between the two friction disk brake surfaces proportional to the relative axial displacement of the two friction disk brake surfaces. The step of generating an axial displacement of two friction disk brake surfaces toward each other comprises axially advancing at least one of the spools on a threaded portion of a shaft wherein at least one of the two friction disk brake surfaces is coupled to the spool. The step of axially advancing at least one of the spools on a threaded portion of a shaft comprises advancing the spool on what is defined in this specification as a Krewsun thread.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1A:
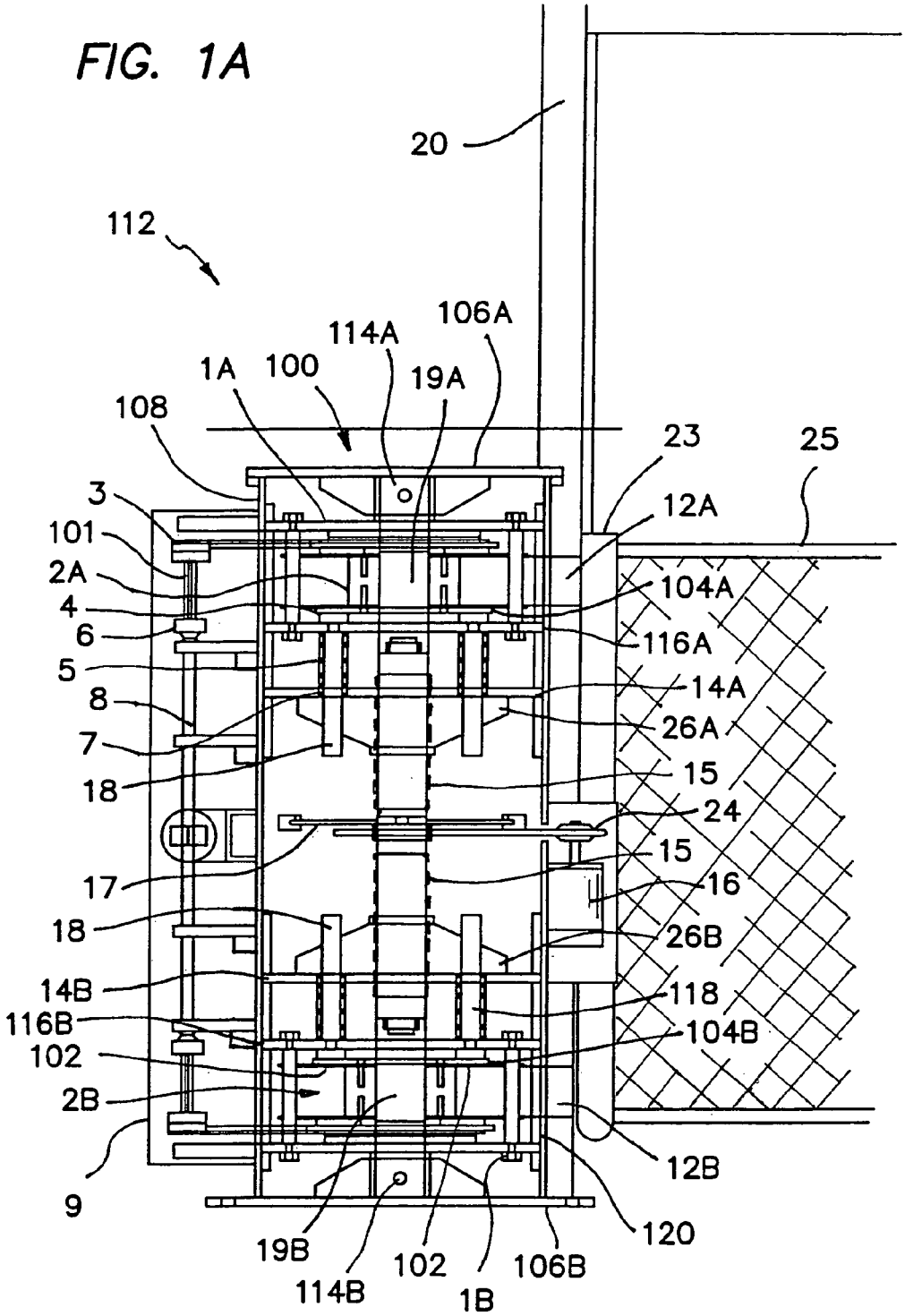
FIGS. 1*a* and 1*b* are cross sectional side views of the right and left towers of one embodiment of the invention.
Figure 1B:
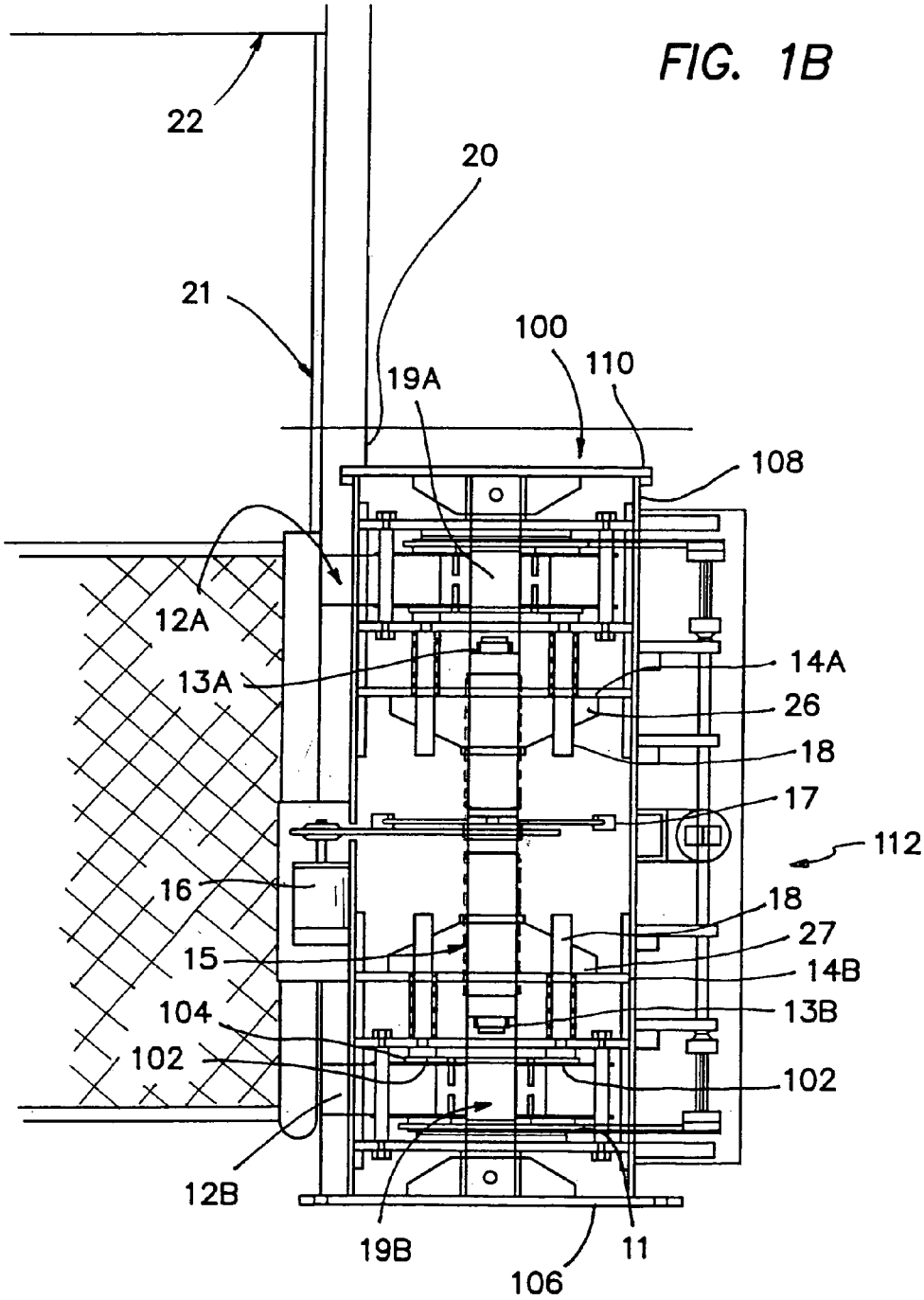

FIG. 1*a* is a side cross-sectional view of the left stanchion 100 from which net 25 is deployed, while FIG. 1*b* is a side cross-sectional view of the right stanchion 100 from which net 25 is deployed. It is inconsequential to the invention of how net 25 is deployed, i.e. whether it is pulled up poles 20 from a trough in the roadway or whether it is lowered to the roadway surface from an elevated position on poles 20 as is the embodiment of the illustration of FIGS. 1*a* and 1*b*. In either case it is advantageous to position the bottom edge of net 25 approximately 4 to 6 inches from the roadway surface. A lower positioning would risk the entrainment of net 25 with the wheels of the vehicle and tend to pull the net 25 under the vehicle. A higher positioning risks slipping the net 25 over the vehicle, particularly with snub nosed or wedge-shaped vehicle body styles.

The left and right stanchions are identical in design other than for their handedness. Net 25 is stretched between a pair of opposing towers 20. Net 25 is coupled to straps 2A and 2B by any means now known or later devised, with a typical means of attachments being a bridle at the end of each strap 2A and 2B. Net 25 may also be raised or lowered on towers 20 between a deployed or stored configuration. The means for lowering or raising net 25 is not material to the invention and any hoisting mechanism well known to the art can be used. Hence, the deployment of net 25 from a concealed or stored configuration to a deployed configuration ready to capture a vehicle will not be further described.

Stanchions 100 are comprised of a cylindrical housing 108 with end flanges 106A and 106B with a shaft 19 concentrically disposed down the middle. Shaft 19 is a three-part shaft. Acme-threaded shaft 15 is journeyed to portions 19A and 19B by press-fit bearings 13A and 13B. Upper and lower portions 19A and 19B have a unique box thread defined thereon and are fixed portions, i.e. portions 19A and 19B are not rotatable. The mid section 15 of shaft 19 is rotatable and is provided with an acme thread described in more detail below.

Referring now to the first embodiment shown in the side cross-sectional views of FIGS. 1*a* and 1*b*, carriages 1A and 1B contained within, are positioned at the top and bottom of stanchion 100. Carriages 1A and 1B each are comprised of two opposing plates set off from each other by a plurality of peripheral standoffs. A plurality of guide bolts 18 are rigidly connected to one of the plates of carriages 1A and 1B. This plate is designated as the pressure plate 116A and 116B. In the lower carriage 1B pressure plate 116B is the upper one of the two opposing plates, while in the upper carriage 1A pressure plate 116A is the lower one of the two opposing plates. In the illustrated embodiment there are a total of 12 guide bolts 18, namely 6 in each of the pressure plates 116A and 116B.

Spools 2A and 2B are concentrically positioned inside carriages 1A and 1B respectively. Carriages 1A and 1B are free to move axially but are rotationally fixed by a plurality of keys 120 provided on the cylindrical housing 108 of stanchion 100 and corresponding slots defined in the periphery of the upper and lower plates of carriages 1A and 1B. Carriages 1A and 1B thus cage spools 2A and 2B, which rotate about end portions 19A and 19B of shaft 19. Shaft portions 19A and 19B have left and right handed threads, which are uniquely designed box threads, described below in connection with FIG. 4, which prevent binding when an extreme side load is applied with the deployment of net 25 which is attached to straps 12A and 12B. The unique square thread design provided on shaft portions 19A and 19B in combination with a corresponding female square thread design on nuts 26A and 26B as described below in connection with FIG. 4 minimizes abrasion and galling of the threading due to the high frictional force exerted by the side loading of spools 2A, 2B.

Straps 12A and 12B are wound on spools 2A and 2B. Spools 2A and 2B have mating and matching left hand, right hand special box threads to loosely fit on to the threading on shafts 19A and 19B. Nut assemblies 26, 27, also riding on shaft 15 are threaded left hand, right hand acme for inline or an axial load force, so that with rotation of the shaft 15, nuts 26, 27 move along the shaft in opposite directions, creating tension on springs 5, which are concentrically disposed on guide bolts 18. As described below, spools 2A and 2B will rotate on shaft portions 19A and 19B to cause the brake to be engaged, while nuts 26A and 26B will be selectively rotated by a motor drive to release the brake.

In the illustrated embodiment there are twelve springs 5 in each stanchion 100, six on each pressure plate. The number of springs 5, their stiffness or spring constant, their size, and their arrangement is chosen in a manner consistent with the disclosed operation of the present invention. The threads on shaft 15 and nuts 26A and 26B are fabricated as threads with fillets 122 as described below in connection with FIG. 3 so that the nuts 26A and 26B axially ride freely during operation of the stopping system to a predetermined degree. Nuts 26A and 26B are integral with thrust plates 14A, 14B so that axial movement of the nuts 26A and 26B as they rotate, axially move the thrust plates 14A, 14B in opposite directions along shaft 15, i.e. as motor 16 rotates shaft 15 nuts 26A and 26B will be axially driven to move thrust plates 14A and 14B either toward or away from each other. Guide bolts 18 slide though clearance holes in thrust plates 14A and 14B and are fixed at their opposing ends to the pressure plates 116A and 116B or carriages 1A, 1B respectively. Springs 5, concentric with guide bolts 18, are axially positioned between the thrust plates 14A, 14B and carriages 1A, 1B. Also positioned between carriages 1A, 1B and strap spools 2A, 2B are brake friction pads 102, which are positioned for engagement with horizontal frictional surface 104A and 104B of spools 2A, 2B respectively. The thrust plates 14A, 14B also contain notches which are keyed to the inside of the stanchion to prevent their rotation.

Consider now the braking operation of the system. When the stopping system is activated, the automobile engages the net 25, driving net 25 forward, pulling out straps 12A and 12B and causing spools 2A, 2B to rotate and move axially toward each other on the box threading on portions 19A and 19B of shaft 19, unwinding the straps 12A, 12B from spools 2A, 2B. The tension applied to straps 12A, 12B by the vehicle rotates the spools 2A, 2B on shaft portions 19A, 19B causing the spools 2A and 2B, and hence carriages 1A, 1B towards the pressure plates 14A, 14B respectively compressing springs 5. During this phase of the operation, nuts 26A and 26B are motionless and maintain their axial position. As springs 5 compress, an increasing frictional force is applied between brake pads 102 and surface 104 of spools 2A, 2B thereby increasing the tension on the straps 12A, 12B and the force applied to net 25, so that the deceleration of the automobile is controlled and gradual.

At this point the brakes will typically be locked up by the force of compression springs 5 locking spools 2A and 2B. After the automobile is stopped and removed from the net 25, electrical motor 16 rotates the shaft 15 through a chain and sprocket combination and nuts 26A and 26B, which are connected to or integral with thrust plates 14A, 14B are rotated in opposite rotational directions moving carriages 1A, 1B away from spools 2A, 2B to release the brake combination 102, 104. Now spools 2A and 2B are freed to rotate and to be rewound.

Then to retrieve net 25, clutches 6 are engaged and a second electrical motor 10 is used to drive a sprocket 3 which is splined to a splined portion 101 of shaft 8, which through a chain and sprocket combination rotates the spools 2A, 2B rewinding straps 12A and 12B back onto spools 2A and 2B and returning them to their original axial position. Shaft 8 is coupled to motor 10 by means of a clutch 6, which free wheels in one direction and drives in the opposing direction. Thus, clutch 6 free wheels when spools 2A and 2B unwind, but engages when motor 10 drives shaft 8 in the opposite direction to wind straps 12A and 12B back onto spools 2A and 2B respectively. Sprocket 3 follows vertically with spools 2A and 2B on spline 101 when spools 2A and 2B are driven vertically by the winding and unwinding of straps 12A and 12B. Motor 10 and 16 are connected to, powered by and controlled by conventional electrical control circuits (not shown).

Figure 5:
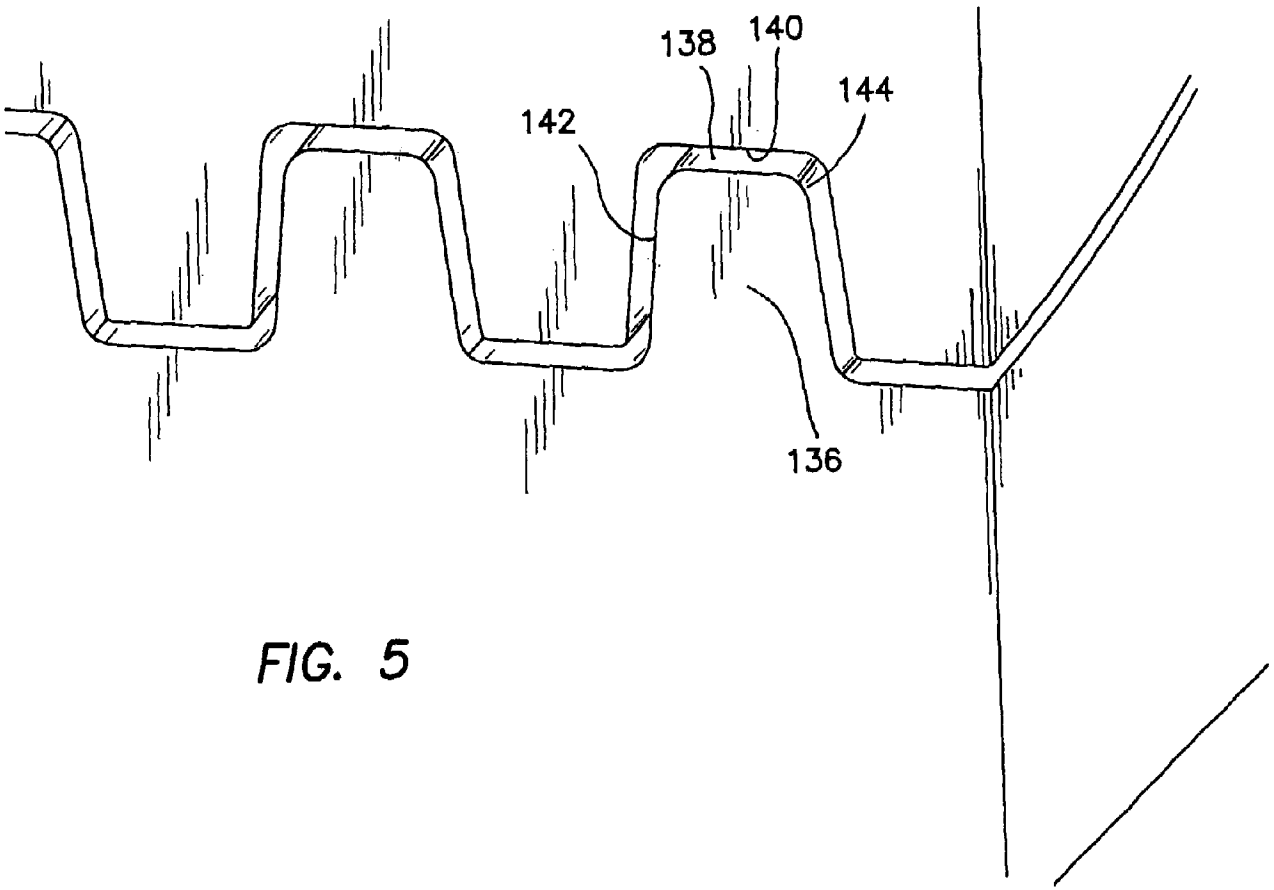
FIG. 5 is a cut away perspective view of a Krewsun threaded coupling between two parts according to the invention.

FIG. 5 is a perspective view of the modified box threading used between spools 2A and 2B and shafts 19A and 19B respectively in the embodiment of FIGS. 1*a* and 1*b*. The use of conventional acme or box threading is not possible, since the high side loads causes the threading to bind, gall and ultimately fuse into a welded mass. Threads 136 are provided with a profile characterized by a flat thread face 138 which is disposed in a flattened thread groove 140. The thread sides 142 have an approximate 5 degree slope with the thread pitch defining approximately 0.010 inch clearance between each adjacent thread face 142. The thread face 138 does not have sharp edges 144, but may be rounded. This screw specification is defined here for the purposes of this specification and the claims as the "Krewsun thread" and is capable of screwing motion or rotationally threaded engagement under high side loads without galling or binding.

More specifically, in the illustrated embodiment the Krewsun thread is a conventional 10 degree modified square thread which has been further modified to have a reduced major and minor pitch diameter. The conventional 10 degree modified square thread in the illustrated embodiment has, for example, a 6 threads per inch pitch with a basic major diameter of 4.000 inches, a basic pitch diameter of 3.9167 inches and basic minor diameter of 3.833 inches, a basic width of the flat at the root of the screw thread of 0.074 inch and basic width of the flat at the crest of the screw thread of 0.076. This conventional screw specification is then modified to obtain the Krewsun thread by providing a pitch diameter of 3.889 inches and a minor diameter of 3.780 inches for the external threading or screw, and a pitch diameter of 3.910 inches and a minor diameter of 3.800 inches for the internal threading or nut. A modified square thread of this geometry means that even when the thread of the screw is fully inserted between the threads of the nut, i.e. the flat crest of the screw thread fully inserted into the root of the threads of the nut, there is still a clearance of several thousandths of an inch between all sides of the screw threads and the nut threads so that no wedging action can occur as would be the case with conventional square threads or acme threads.

Figure 2:
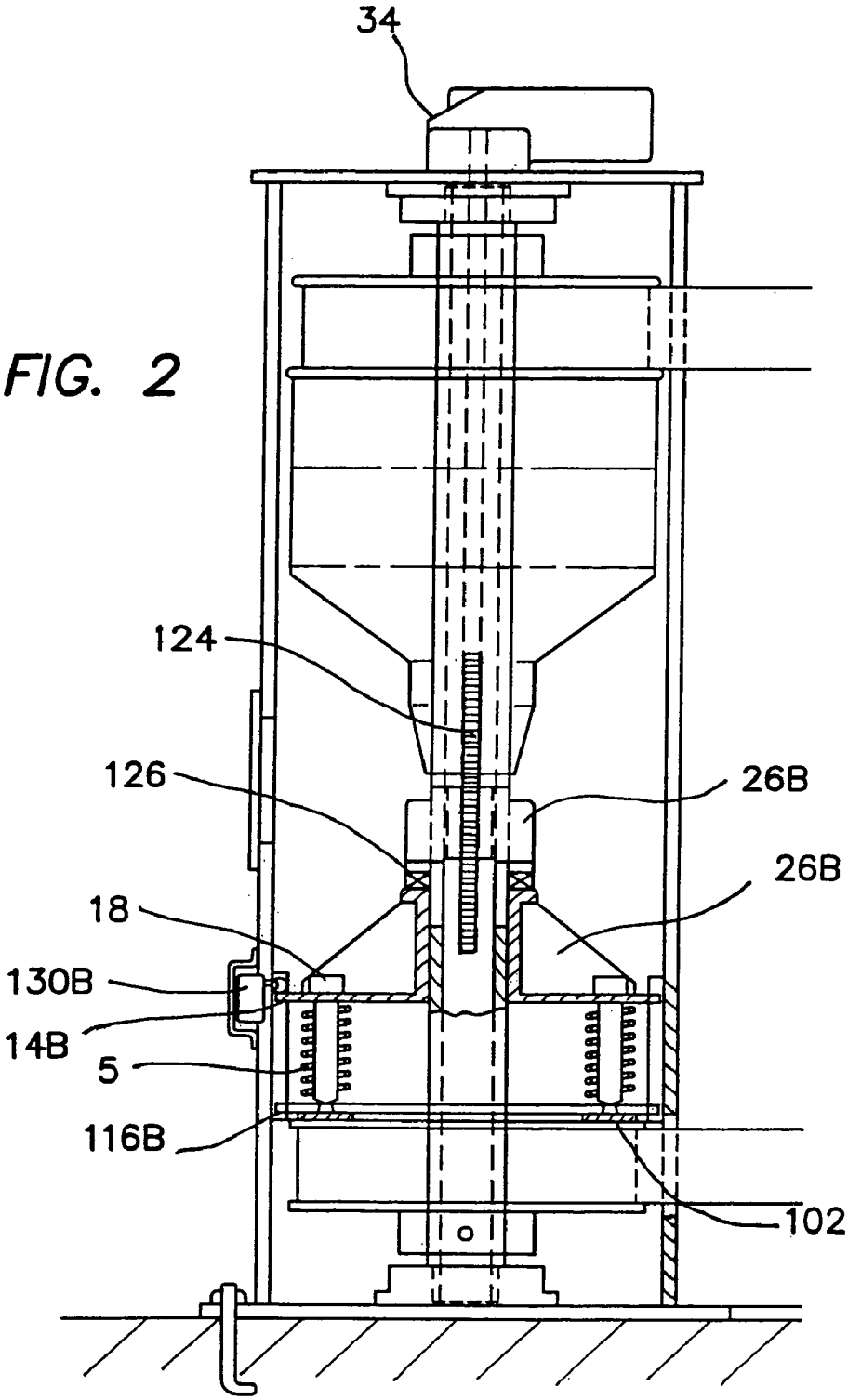
FIG. 2 is a cross sectional side view of a second embodiment of a tower of the invention.

FIG. 2 is a simplified side cross-sectional view of a second embodiment which is the same as the embodiment described in connection with FIGS. 1*a* and 1*b* except for the modifications described below. In this embodiment, axial shaft 19 is a single integral, threaded hollow cylindrical shaft held in end bearings 114A and 114B with exterior threading on upper and lower portions 19A and 19B as before. Spools 2A and 2B are rotationally fixed to the ends of shaft 19 and rotate with it, i.e. they freely rotate to allow straps 12A and 12B to be unwound and spools 2A and 2B do not ride up or down Krewsun threads.

Figure 4:
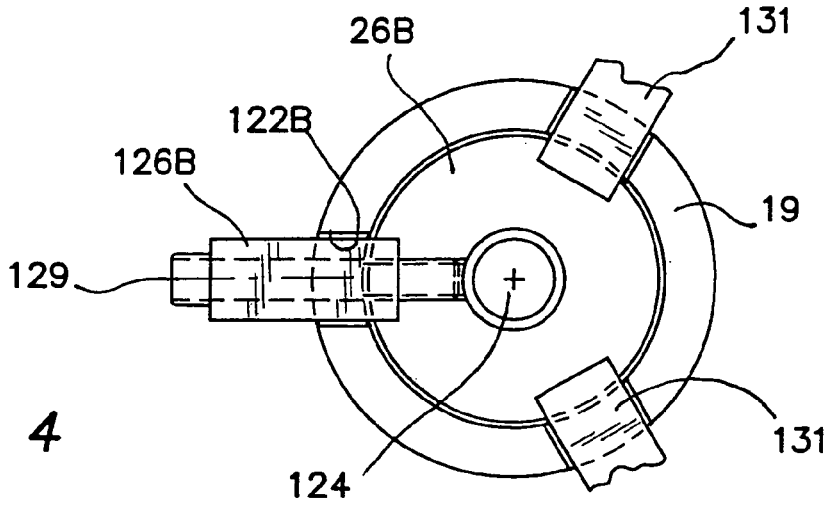
FIG. 4 is a cross sectional plan view of the rod and shaft coupling of FIG. 3 as taken through section lines 4—4 of FIG. 3.
Figure 3:
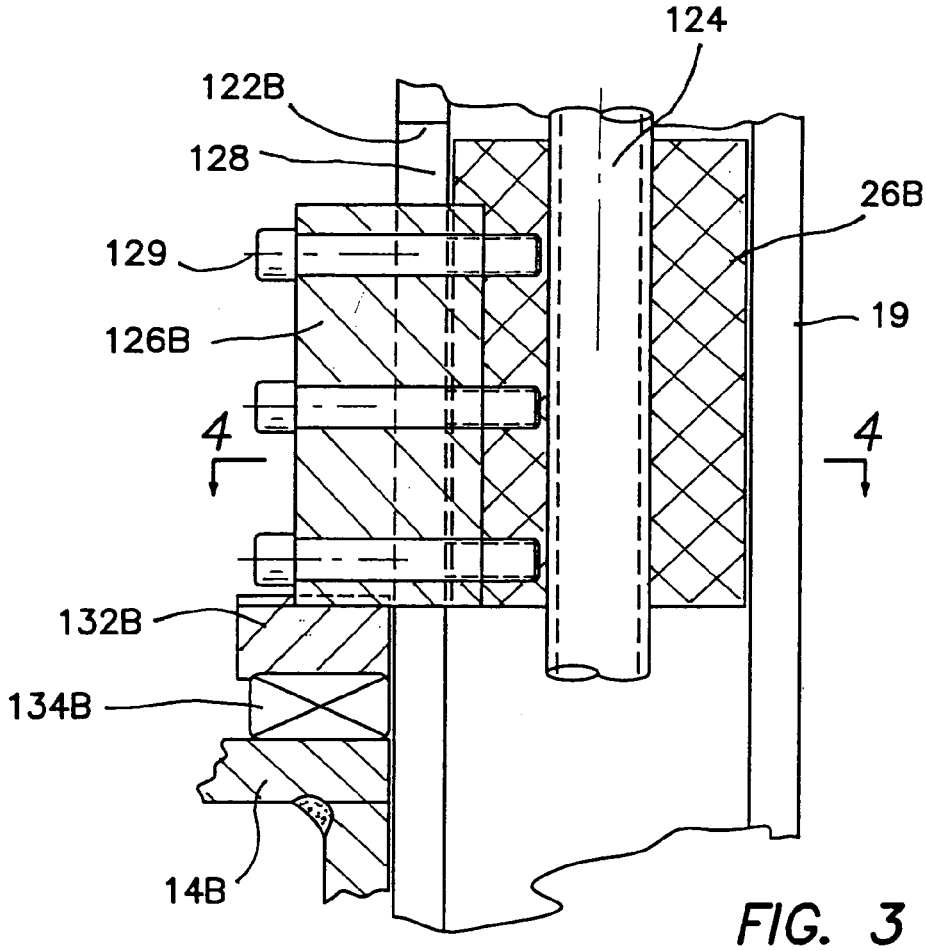
FIG. 3 is a side cross sectional view of a rod and shaft coupling which is a portion of the brake thrust drive and releasing mechanism of the embodiment of FIG. 2.

Motor/clutch assembly 34 is directly coupled to an axial rod 124 through a clutch. Motor/clutch assembly 34 is connected to, powered by and controlled by conventional electrical control circuits (not shown) and may include limit switches 130A, 130B to sense the position of thrust plate 14A, 14B. Threaded rod 124 is concentrically disposed in hollow shaft 19 and is threadably coupled to nuts 26A and 26B as shown in FIG. 3. FIG. 3 is a side cross-sectional view of the coupling between nuts 26A and 26B and rod 124. Rod 124 disposed in hollow shaft 19 is threadably coupled to nut 26A and 26B. A fillet or slot 122A, 122B is defined through shaft 19 through which a fillet block 126A, 126B is bolted by bolts 129, 131 to nut 26A and 26B to prevent rotation of nut 26A, 26B relative to shaft 19. FIG. 4 is a cross sectional plan view taken through section lines 4—4 of FIG. 3. Block 126A, 126B rides axially within slot 122A, 122B for a predetermined distance by a defined amount of freedom of axial movement.

As spools 2A and 2B unwind, shaft 19 is rotated, which rotates nuts 26A, 26B by means of their coupling with fillet blocks 126A and 126B. Rod 124 is rotational fixed at this point in time by means of the rotational locking provided by the clutch in motor/clutch assembly 34. This rotation causes thrust collar 132A, 132B to be screwed against thrust bearing 134A, 134B and hence to axially move thrust plate 14A, 14*b* toward opposing pressure plate 116A, 116B. As before this will ultimately cause a braking force to be applied to spools 2A, 2B and the vehicle brought to a stop. Generally, at this point in time, the brakes will be locked up.

At this point, motor/clutch assembly 34 is turned on and rod 124 is rotated through the clutch mechanism which is part of motor/clutch assembly 34. As rod 124 is rotated, nut 26A, 26B is axially drawn toward the midpoint of shaft 19 until fillet block 126A, 126B hits the extreme end of slot 122A, 122B. Pressure is released from the thrust plate assembly 14A and 14B by allowing it to axially back off, to release the brake and to reset thrust plate assembly 14A and 14B in its original axial position. When the extreme end of slot 122A, 122B is reached, rod 124 will become rotationally locked to shaft 19 through fillet block 126A, 126B, and rod 124 and shaft 19 will begin to rotate together. Continued rotation of rod 124 rotates shaft 19, which rotates spools 2A, 2B and rewinds straps 12A, 12B onto spools 2A, 2B.

Initially, shaft 19 is free to rotate in a direction which allows spools 2A and 2B to unwind straps 12A and 12B by means of the free wheeling of a clutch in motor/clutch assembly 34. When a vehicle is captured by net 25, spools 2A and 2B unwind as before and are driven against pressure plates 116A and 116B, squeezing the brake pads 102 between them. Note that in this embodiment the two plates of carriages 1A and 1B have been eliminated leaving only the one pressure plate 116A and 116B respectively, which is still coupled thrust plates 14A and 14B respectively through guide bolts 18 and compression springs 5. Spools 2A and 2B are uncaged.

In summary, it has been found according to the invention that an all mechanical brake in a vehicle stopping system in which the brake force is increased proportionately as the straps connected to the net are extended stops the vehicle with minimal chance of injury either to the driver or to the vehicle. There is no abrupt application of restraining force, but the restraining force is applied from a zero or near zero level to increasing higher levels until the forward force of the vehicle due to inertia or forward drive is overcome. Even when the forward force of the vehicle is abruptly terminated as when the vehicle comes to a full stop and the engine cut off, there is no rebound restraining force which tends to snap the vehicle and its driver back.

Furthermore, it has been found that deploying two spaced-apart straps from each of the two opposing towers allows the net to be stably deployed regardless of the shape of the vehicle or its velocity. In other words the net is retained by four straps which diverge from each other as they extend back to the towers, instead of a net on a bridle tethered by two straps extending back to the tower. Such prior art strap and bridle configurations result in a high percentage of failures to capture the vehicle, because the net slips over or under the vehicle. Even snub nose vehicles which by reason of their forward shape tend to dive under prior art capture nets which are held on bridles at the end of a pair of straps, are reliably captured by the nets when deployed with the four separated strap configuration of the invention.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A vehicle stopping system including a vehicle capture net disposed between a pair of towers, each tower including a stanchion comprising:

a shaft;

a pair of spaced apart spools coupled to the shaft;

a corresponding pair of straps having one end coupled to one of the pair of spools and the other end coupled to one side of the net, each strap being wound on one of the spools; and braking means coupled to the shaft and operatively connected to the spools for providing a restraining force of increasing magnitude on the straps as the straps are unwound from the spools, where the braking means comprises a mechanical brake providing a braking force proportional to the degree of compression of the mechanical brake, having two braking surfaces in frictional relationship with each other and where the degree of compression is the magnitude of displacement of one braking surface relative to the other braking surface, where the magnitude of displacement of one braking surface relative to the other braking surface comprises the screw advance of the spools on the shaft toward the brake as caused by the unwinding of the straps from the spools where the shaft and spools are provided with and engaged with each other by a flat faced screw with a thread-to-thread clearance of at least 0.010 inch.

2. A vehicle stopping system including a vehicle capture net disposed between a pair of towers, each tower including a stanchion comprising:

a shaft; a pair of spaced apart spools coupled to the shaft;

a corresponding pair of straps having one end coupled to one of the pair of spools and the other end coupled to one side of the net, each strap being wound on one of the spools;

braking means coupled to the shaft and operatively connected to the spools for providing a restraining force of increasing magnitude on the straps as the straps are unwound from the spools, where the braking means comprises a mechanical brake providing a braking force proportional to the degree of compression of the mechanical brake, having two braking surfaces in frictional relationship with each other and where the degree of compression is the magnitude of displacement of one braking surface relative to the other braking surface; and means for rewinding the straps onto the spools, where the spools are rotationally fixed to the shaft, where the means for rewinding the straps onto the spools comprises a single electric motor and clutch assembly coupled to the shaft, and where the braking means includes a threaded rod directly coupled to the motor and clutch assembly, the rod being coupled to the shaft by a block and axial slot combination which permits a degree of axial movement of the block, so that when the rod is selectively held rotationally fixed by the motor and clutch assembly, unwinding of the spools rotates the shaft and axially activates the braking means.

3. The vehicle stopping system of claim 2 further comprising means for releasing the braking means including the single electric motor/clutch assembly directly coupled to the threaded axial rod which is coupled to the shaft by means of the block and axial slot combination, so that rotation of the rod by the motor/clutch assembly in a predetermined direction serves to release the braking means, and so that further rotation of the rod by the motor/clutch assembly rotates the shaft by means of the block and axial slot combination thereby serving to rewind the straps onto the spools.

4. A method of stopping a vehicle comprising:

deploying a vehicle capture net having each of its opposing sides connected to a pair of straps each of which is wound on a corresponding spool;

permitting the vehicle to collide with the capture net and to unwind the straps from corresponding spools; and providing a restraining force on the spools of increasing magnitude as the straps are unwound from the spools where providing a restraining force of increasing magnitude on the straps as the straps are unwound from the spools comprises providing mechanical friction braking to generate restraining force in which the brake pressure is proportional to the length of the straps unwound from the spools, where providing mechanical friction braking to generate restraining force in which the brake pressure is proportional to the length of the straps unwound from the spools comprises generating an axial displacement of two friction disk brake surfaces toward each other as a function of the length of the straps unwound from the spools.

5. A method of stopping a vehicle comprising:

deploying a vehicle capture net having each of its opposing sides connected to a pair of straps each of which is wound on a corresponding spool; permitting the vehicle to collide with the capture net and to unwind the straps from corresponding spools; and providing a restraining force on the straps of increasing magnitude as the straps are unwound from the spools by providing mechanical friction braking to generate the restraining force in which the brake pressure is proportional to the length of the straps unwound from the spools by in turn generating an axial displacement of two friction disk brake surfaces toward each other as a function of the length of the straps unwound from the spools; and where generating an axial displacement of two friction disk brake surfaces toward each other as a function of the length of the straps unwound from the spools comprises axially advancing at least one of the spools on a threaded portion of a shaft wherein at least one of the two friction disk brake surfaces is coupled to the spool.

6. The method of claim 5 where axially advancing at least one of the spools on a threaded portion of a shaft comprises advancing the spool on a Krewsun thread.

7. A vehicle stopping system including a vehicle capture net disposed between a pair of towers, each tower including a stanchion comprising:

a shaft; a pair of spaced apart spools coupled to the shaft;

a corresponding pair of straps having one end coupled to one of the pair of spools and the other end coupled to one side of the net, each strap being wound on one of the spools; and braking means coupled to the shaft and operatively connected to the spools for generating a restraining force applied to the spools of increasing magnitude at a substantially uniform rate to the spools throughout substantially the entire unwinding range as the straps are unwound from the spools.

8. A vehicle stopping system including a vehicle capture net disposed between a pair of towers for restraining a vehicle, each tower including a stanchion comprising:

a shaft;

a pair of spaced apart spools coupled to the shaft;

a corresponding pair of straps having one end coupled to one of the pair of spools and the other end coupled to one side of the net, each strap being wound on one of the spools; and braking means coupled to the shaft and operatively connected to the spools for providing a restraining force of increasing magnitude on the straps as the straps are unwound from the spools, where the braking means comprises a mechanical brake providing a braking force proportional to the degree of compression of the mechanical brake, having two braking surfaces in frictional relationship with each other and where the degree of compression is the magnitude of displacement of one braking surface relative to the other braking surface, where the magnitude of displacement of one braking surface relative to the other braking surface comprises the screw advance of the spools on the shaft toward the brake as caused by the unwinding of the straps from the spools where the shaft and spools are provided with and engaged with each other by a threaded screw having a thread design capable of sustaining a side loading force applied to the screw and arising from the capture of the vehicle in the capture net the without causing the screw to bind or gall.

* * * * *